US012516614B2

(12) United States Patent
Casellas et al.

(10) Patent No.: US 12,516,614 B2
(45) Date of Patent: Jan. 6, 2026

(54) GREEN COMPACT OF A STATOR-COVER UNIT

(71) Applicant: GKN Sinter Metals Engineering GmbH, Radevormwald (DE)

(72) Inventors: Antonio Casellas, Siegburg (DE); Rainer Schmitt, Wachtberg (DE); Sascha Frey, Troisdorf (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 981 days.

(21) Appl. No.: 16/471,825

(22) PCT Filed: Dec. 11, 2017

(86) PCT No.: PCT/EP2017/082144
§ 371 (c)(1),
(2) Date: Jun. 20, 2019

(87) PCT Pub. No.: WO2018/114413
PCT Pub. Date: Jun. 28, 2018

(65) Prior Publication Data

US 2020/0095905 A1 Mar. 26, 2020

(30) Foreign Application Priority Data

Dec. 23, 2016 (DE) ..... 10 2016 125 659.5

(51) Int. Cl.
*F01L 1/34* (2006.01)
*B22F 3/16* (2006.01)
(Continued)

(52) U.S. Cl.
CPC ..... *F01L 1/344* (2013.01); *B22F 3/16* (2013.01); *B22F 5/009* (2013.01); *B22F 7/062* (2013.01); *F01L 1/46* (2013.01)

(58) Field of Classification Search
CPC . F01L 1/344; F01L 1/46; F01L 1/3443; F01L 2250/02; F01L 2301/00;
(Continued)

(56) References Cited

U.S. PATENT DOCUMENTS 5,250,255 A * 10/1993 Sagawa ..... B22F 3/02 419/38
6,457,447 B1 * 10/2002 Sato ..... F01L 1/344 123/90.17
(Continued)

FOREIGN PATENT DOCUMENTS

DE 102010008004 A1 8/2011
DE 102014200818 A1 * 1/2015 ..... B23K 20/026
(Continued)

OTHER PUBLICATIONS

National Intellectual Property Administration, P. R. China, First Office Action and Search Report, Application No. 201780079824.4, Jan. 13, 2021, 7 pages [English Language Translation Only].

*Primary Examiner* — Mark A Laurenzi
*Assistant Examiner* — Kelsey L Stanek
(74) *Attorney, Agent, or Firm* — Quarles & Brady LLP

(57) ABSTRACT

A green compact of a stator-cover unit for a camshaft adjuster unit, at least comprising a first partial green compact, as a stator, made of a first sinter material, in each case with a first end-face side and a second end-face side pointing in an axial direction, and in between a plurality of webs having lateral web flanks, wherein the webs, starting from an outer stator wall running in a circumferential direction, extend inwardly in a radial direction and are spaced apart from one another in the circumferential direction, so that the stator wall in each case forms an inner circumferential surface between the webs, and a second partial green compact, as a cover, made of a second sinter material, having an outer circumferential surface running in the circumferential
(Continued)

Figure 1:
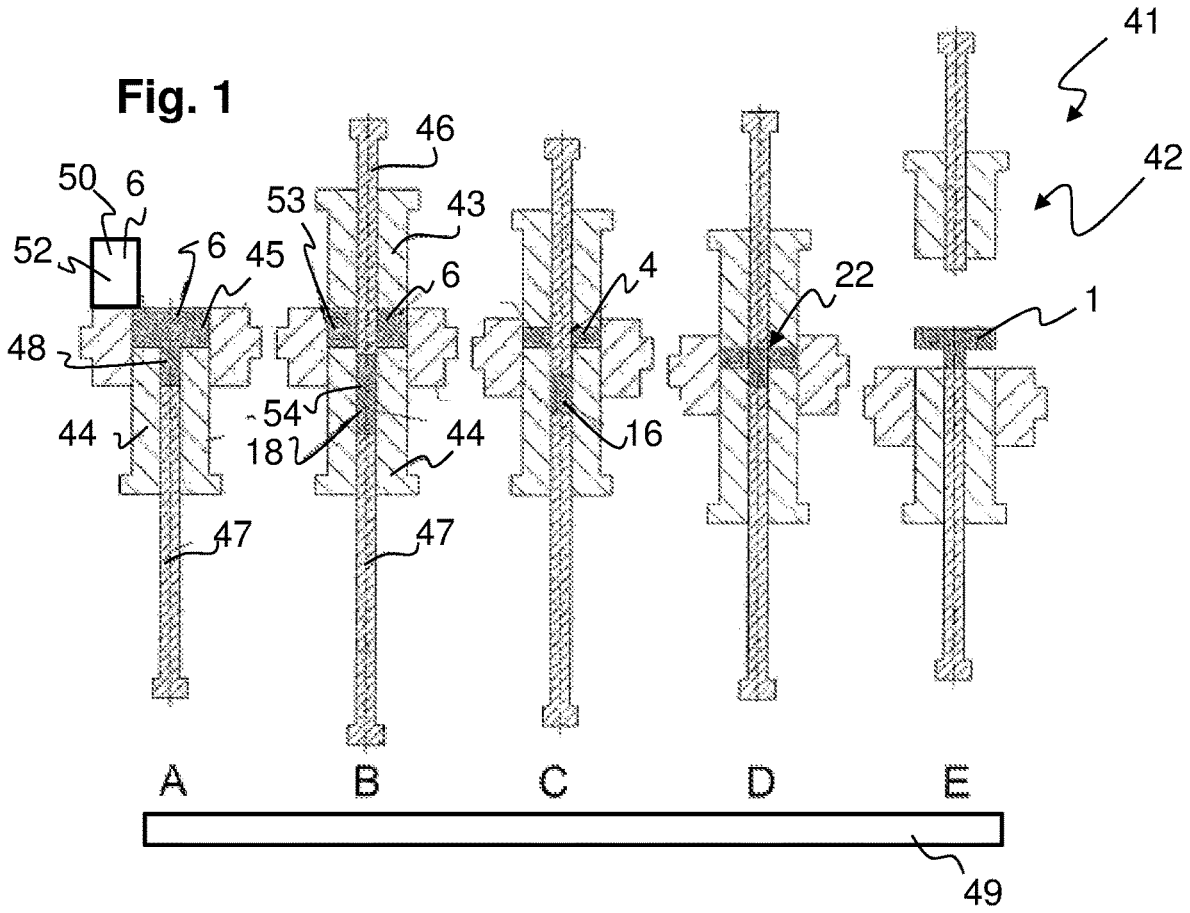

direction and situated on the first end-face side of the stator and at least partially covering a first area extending between the webs and within the stator wall;

wherein the outer circumferential surface of the cover adjoins the inner circumferential surface and the web flanks of the stator and forms shared contact surfaces, and the cover and the stator are joined together via these contact surfaces by means of a press fit.

20 Claims, 4 Drawing Sheets

(51) Int. Cl.

| | |
|---|---|
| ***B22F 5/00*** | (2006.01) |
| ***B22F 7/06*** | (2006.01) |
| ***F01L 1/344*** | (2006.01) |
| ***F01L 1/46*** | (2006.01) |

(58) Field of Classification Search

CPC ..... F01L 2820/01; F01L 2303/0001; F01L 2001/34426; F01L 1/02; F01L 1/026; F01L 1/04; F01L 1/047; F01L 1/08; B22F 3/16; B22F 5/009; B22F 7/062; B22F 2003/245; B22F 2003/247; B22F 2003/248; B22F 3/10; B22F 3/12; B22F 3/162; B22F 3/24; B22F 5/00; B22F 5/008; B22F 5/08; B22F 5/085

IPC ..... B22F 7/062,3/16, 5/009, 3/10, 3/12, 3/162, 3/24, 5/00, 5/008, 5/08, 5/085, 2003/245, 2003/247, 2003/248; F01L 2250/02,2301/00, 2820/01, 2303/00, 2303/01, 1/344, 1/46, 1/3442, 2001/34426, 1/02, 1/026, 1/04

See application file for complete search history.

(56) References Cited

U.S. PATENT DOCUMENTS

| | | | | |
|---|---|---|---|---|
| 7,640,902 | B2 | 1/2010 | Knecht et al. | |
| 2009/0257905 | A1* | 10/2009 | Hartner | B22F 3/03 425/78 |
| 2012/0037104 | A1 | 2/2012 | Pohl et al. | |
| 2012/0216654 | A1* | 8/2012 | Schmitt | B22F 7/062 75/228 |
| 2012/0298061 | A1* | 11/2012 | Boese | F01L 1/3442 123/90.17 |

FOREIGN PATENT DOCUMENTS

| | | | |
|---|---|---|---|
| DE | 102013226466 | | 6/2015 |
| EP | 2372119 | A1 | 10/2011 |
| GB | 2320032 | A | 6/1998 |
| GN | 1908384 | B | 5/2012 |
| JP | 2007247655 | | 9/2007 |
| WO | 2014056489 | A1 | 4/2014 |
| WO | 2015169746 | A1 | 11/2015 |
| WO | 2015169756 | A2 | 11/2015 |

* cited by examiner

Fig. 3
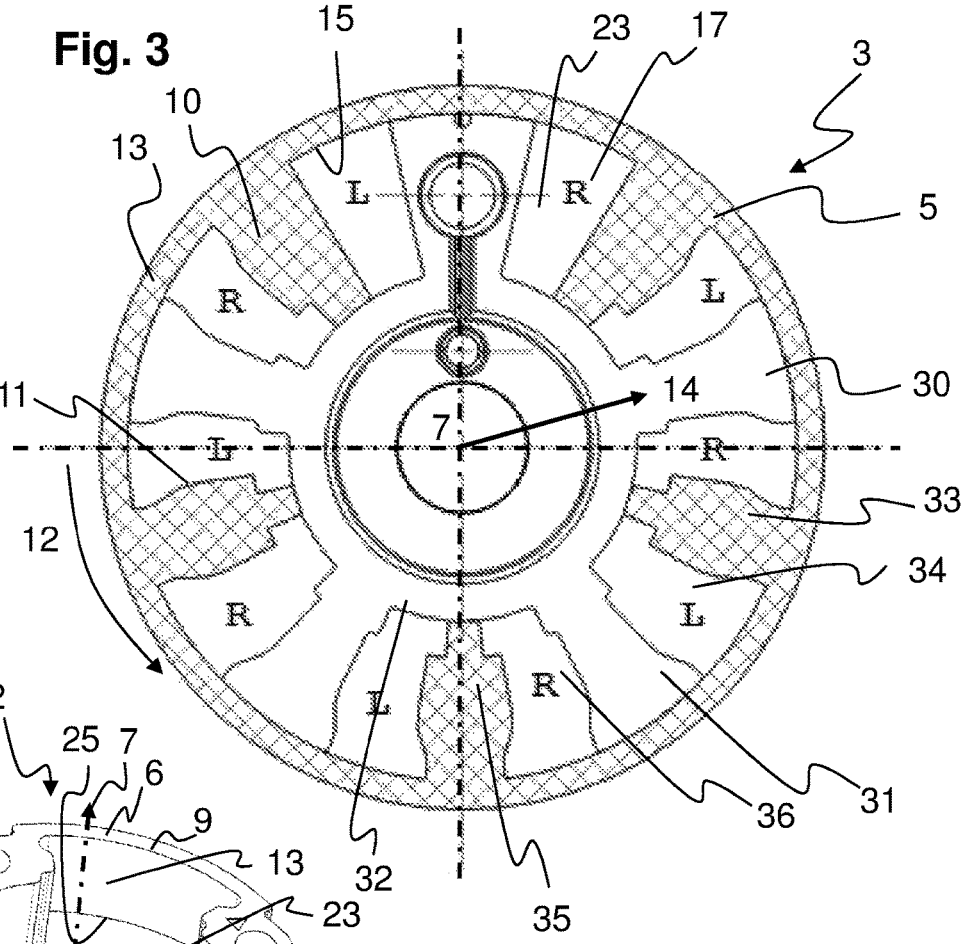
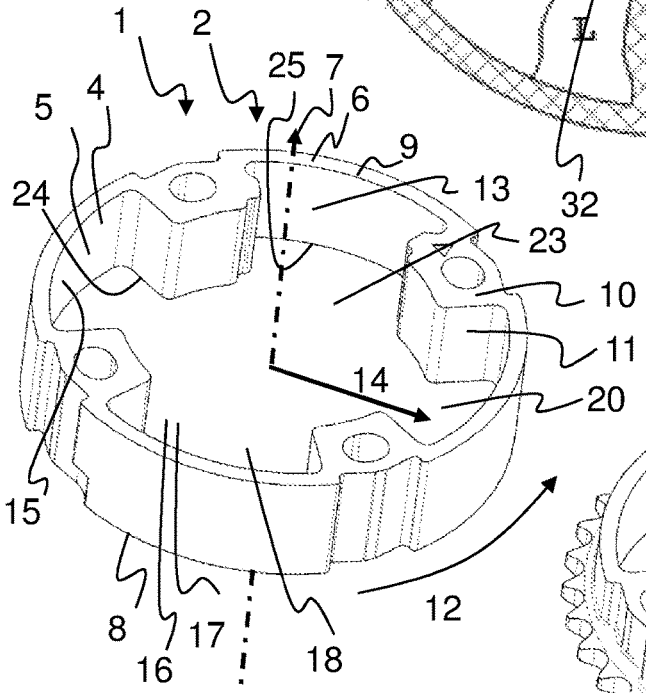
Fig. 4
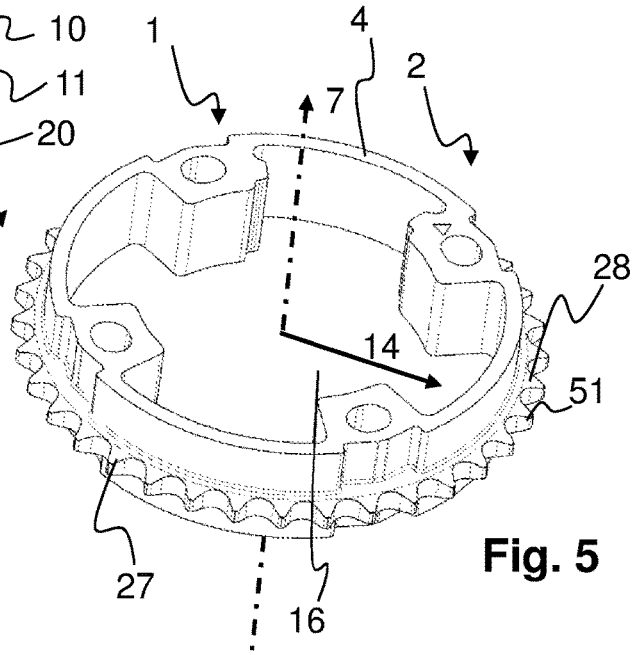
Fig. 5

Fig. 6
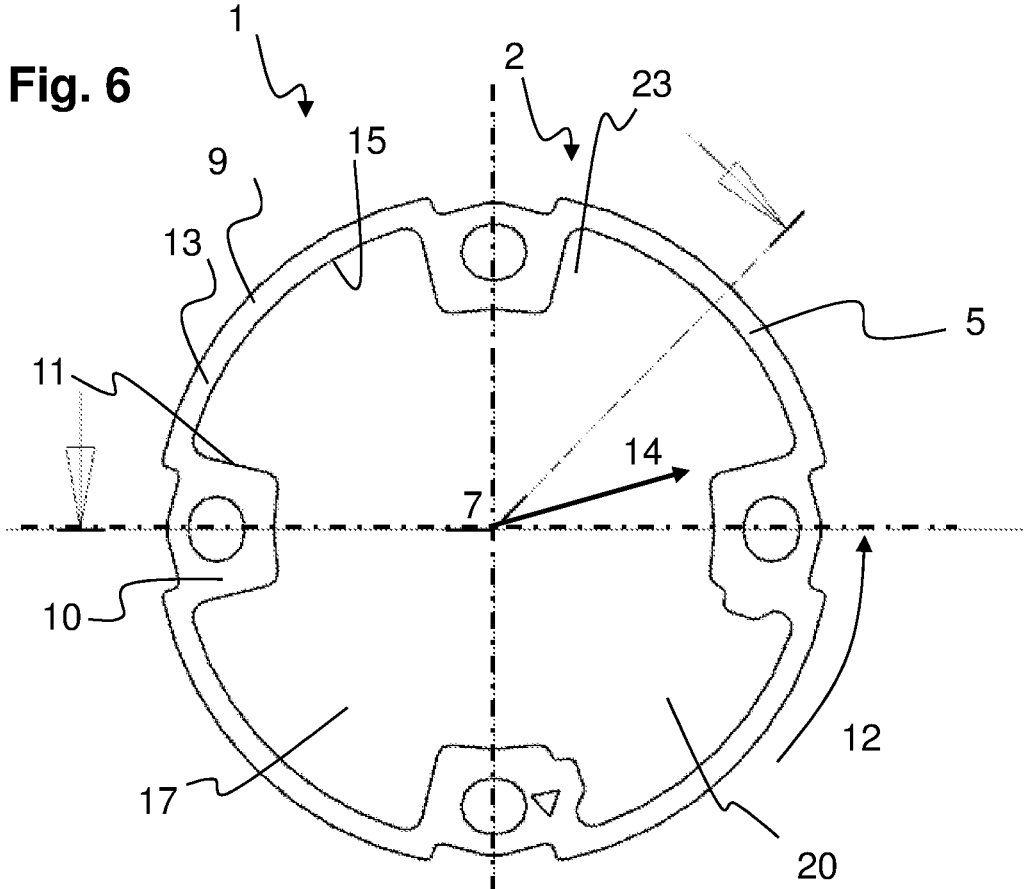
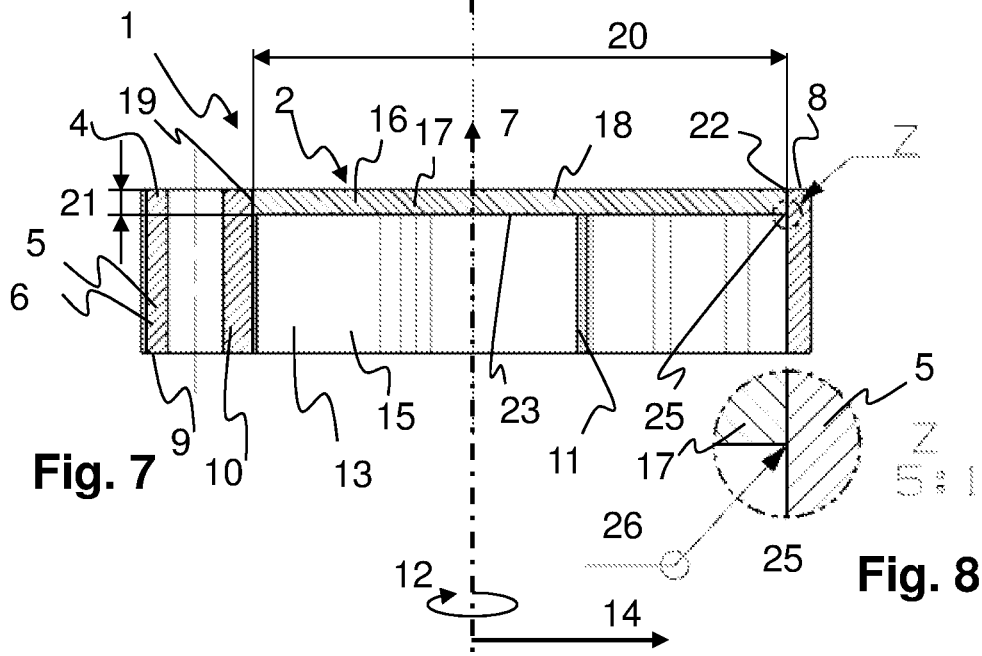
Fig. 7
Fig. 8

Fig. 9
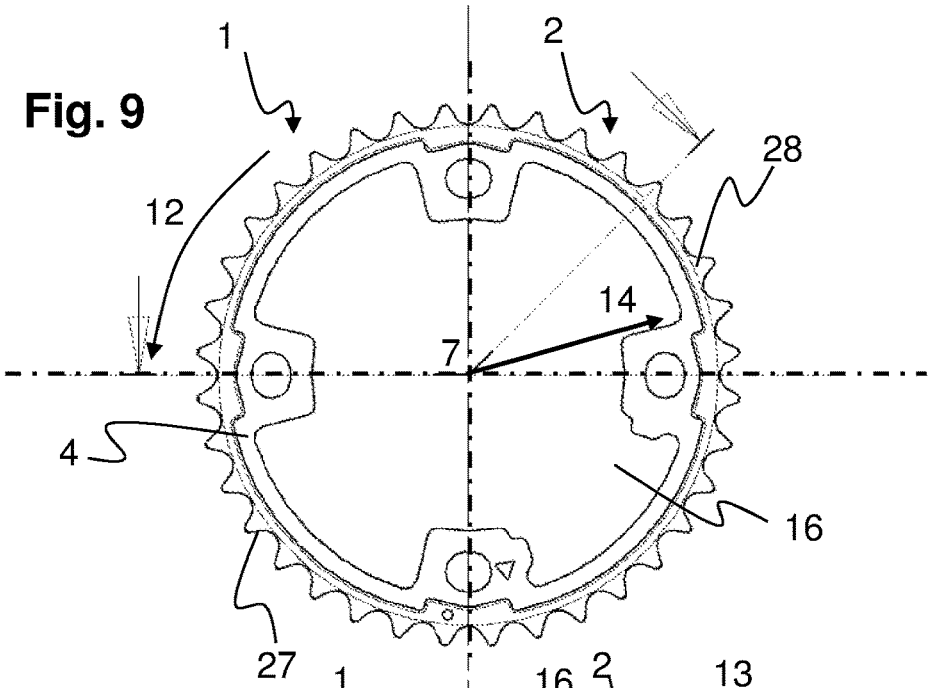
Fig. 10
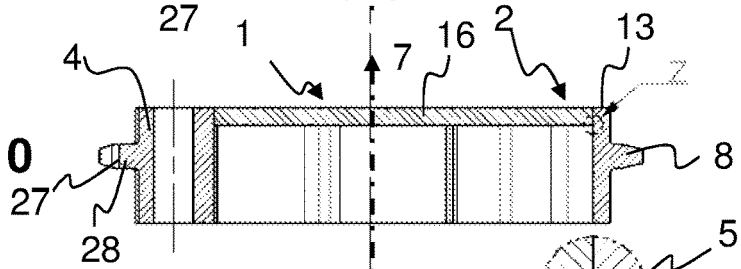
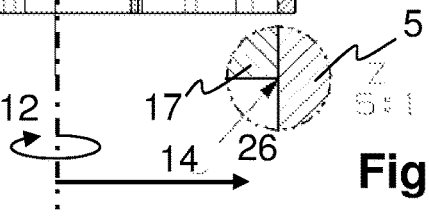
Fig. 11
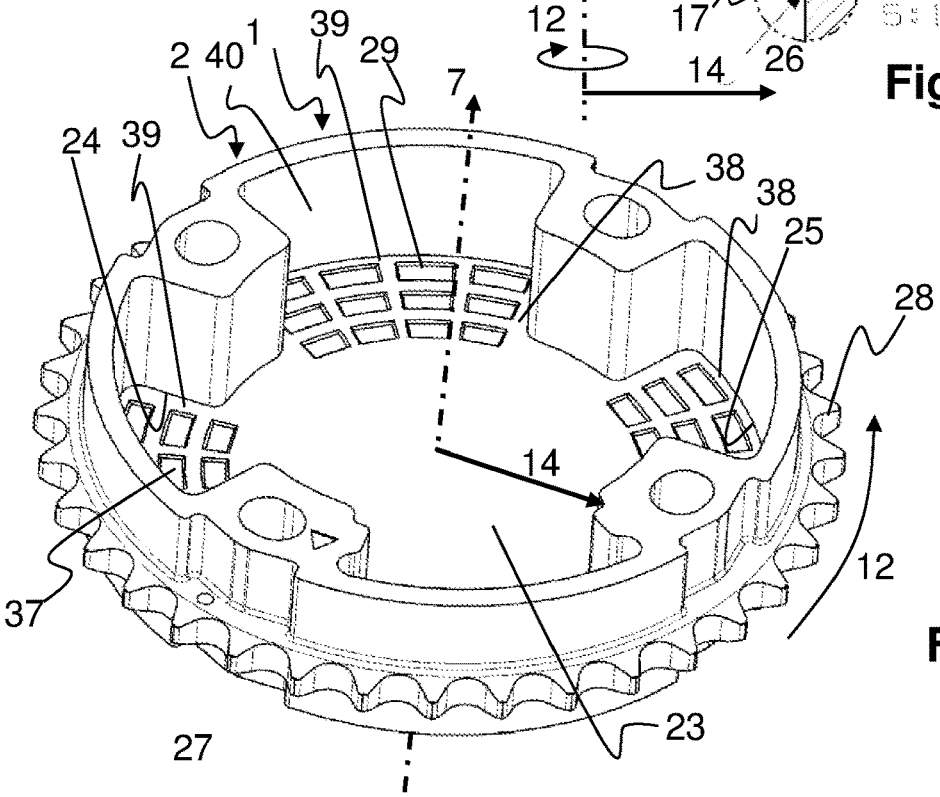
Fig. 12

GREEN COMPACT OF A STATOR-COVER UNIT

This application represents the U.S. national stage entry of International Application No. PCT/EP2017/082144 filed Dec. 11, 2017, which claims priority to German Patent Application No. 10 2016 125 659.5 filed Dec. 23, 2016, the disclosure of which is incorporated herein by reference in its entirety and for all purposes.

The present invention relates to a green compact of a stator-cover unit for a camshaft adjuster unit. The camshaft adjuster unit is used in particular for hydraulic adjustment of the phase position of a camshaft relative to a crankshaft of an internal combustion engine.

So-called camshaft adjuster units are used for camshafts that actuate the valves, not only to increase power and torque, but also to reduce the fuel consumption and pollutant emissions from internal combustion engines. By use of these camshaft adjuster units, the intake and exhaust timing may be variably adjusted by controlling the valves. In view of the high reliability and also costs, hydraulic camshaft adjuster units, i.e., camshaft adjuster units that are actuatable by a hydraulic fluid (motor oil, for example), have become prevalent. These units include a rotor that is accommodated in a housing and mounted so as to be pivotable with respect to the housing. The pivoting adjusts the rotational angle position of a camshaft, connected to the rotor, relative to a crankshaft of the internal combustion engine. The housing forms a stator with inwardly pointing webs, which together with blades of the rotor form chambers with a changeable volume.

A stator for such a camshaft adjuster unit, formed by a one-piece sintered component, is known from DE 10 2010 003 546 A1. A likewise one-piece green compact is provided for this purpose. This green compact is formed by pressing a metal powder in a mold, which in this case already corresponds to the shape of the stator. It is known from DE 10 2010 003 546 A1 that mechanical finishing of the sintered component is necessary. In particular, the transitions from the webs of the stator (referred to therein as blades of the stator) to the base of the stator, over which the blades of the rotor slide during operation of the camshaft adjuster unit, must be finished in order to provide preferably right-angle transitions that are free of bevels.

A stator-cover unit for a camshaft adjuster unit that is produced by sintering and can be used without mechanical finishing is known from DE 10 2010 008 004 A1. At the above-mentioned transitions from the webs of the stator to the base thereof, depressions are provided in which production-related material overhangs may remain. The depressions provide areas over which the blades of the rotor can slide during operation of the camshaft adjuster unit, despite the possible presence of material overhangs. However, such depressions require a correspondingly wider design of the blade, viewed in the circumferential direction, in order to avoid leakage of the hydraulic fluid from one chamber into the adjoining chamber via the blade. In addition, there is greater leakage flow with such a design.

The object of the invention, therefore, is to at least partially solve the problems present with the prior art, and in particular to provide a green compact of a stator-cover unit that is preferably cost-effectively manufacturable and usable in a camshaft adjuster unit, in particular with little or no mechanical finishing.

These objects are achieved with a green compact according to the features of Patent claim 1. Further advantageous embodiments of the green compact as well as higher-level modules, presses, and methods for manufacturing the green compact are set forth in the dependent patent claims. It is pointed out that the features individually stated in the dependent patent claims may be combined with one another in a technologically meaningful way, defining further embodiments of the invention. Furthermore, the features set forth in the patent claims are specified and explained in greater detail in the description, in which further preferred embodiments of the invention are described.

A green compact of a stator-cover unit for a camshaft adjuster unit is proposed, comprising at least a first partial green compact, as a stator, made of a first sinter material, in each case with a first end-face side and a second end-face side pointing in an axial direction, and in between a plurality of webs having lateral web flanks, wherein the webs, starting from an outer stator wall running in a circumferential direction, extend inwardly in a radial direction and are spaced apart from one another in the circumferential direction, so that the stator wall in each case forms an inner circumferential surface between the webs, and a second partial green compact, as a cover, made of a second sinter material, having an outer circumferential surface running in the circumferential direction and situated on the first end-face side of the stator and at least partially covering a first area extending between the webs and within the stator wall;

wherein the outer circumferential surface of the cover adjoins the inner circumferential surface and the web flanks of the stator and forms shared contact surfaces, and the cover and the stator are joined together via these contact surfaces by means of a press fit.

In this regard, reference is made in particular to the method already known from DE 10 2009 042 598 A1 and the devices described therein. In the cited document it is proposed to join two or more green compacts together via press fits. Due to the special tool design of the press and the advantageous travel paths of the pressing punches, press fits with a fairly large coverage are possible without the partial green compacts being damaged during the arrangement relative to one another. In contrast, during the displacement or movement of the partial green compacts relative to one another for arranging the partial green compacts with a press fit, the mutually contacting surfaces of the partial green compacts slide on one another, resulting in particularly advantageous strength of the connection of the partial green compacts during the subsequent sintering, via the mutually contacting shared contact surfaces.

It has now surprisingly been found that by use of this method it is possible to arrange the partial green compacts relative to one another, achieving sharp-edged and in particular right-angled edges at the transitions from one partial green compact to the other partial green compact, viewed in a cross section. Due to a particularly advantageous separation of the green compact into a first partial green compact that forms the stator, and a second partial green compact that forms the cover, it is now possible to create the transitions mentioned with regard to the prior art, in particular without material overhangs, and thus without the requirement for mechanical or other material-removing finishing.

The press fit is formed in particular by an overlap of the partial green compacts in a radial direction, which is present when the partial green compacts have not yet been joined to form the green compact, in particular by moving the partial green compacts relative to one another along the axial direction. That is, the first partial green compact extends inwardly, for example in a radial direction, until it forms an overlap with the second partial green compact extending outwardly in the radial direction. As a result of this overlap, in the subsequent arrangement of the partial green compacts relative to one another, the partial green compacts are joined together in a frictionally engaged and dimensionally stable manner and form the green compact, which is then further processed by sintering to provide the ready-to-use stator-cover unit.

Force-fit connections require a normal force on the surfaces to be joined together, in the present case the shared contact surfaces. They are prevented from moving relative to one another as long as the counterforce produced by the static friction is not exceeded.

In particular, overlaps of at least 0.005 millimeter to at most 0.04 millimeter, preferably to at most 0.025 millimeter, with diameters of the contact surfaces in a range of 50 to 200 millimeters, are provided. "Overlap" refers here to the difference between the radii of the partial green compacts.

As stated above, the first area extends between the webs and within the stator wall, and is covered by the cover. In particular, the first area extends over the entire surface, which in the radial direction is delimited on the outside only by the stator wall and the webs. In particular an opening is provided in the middle of the stator wall, through which a camshaft subsequently extends, in which case the first area extends only to the opening.

In particular, the outer circumferential surface of the cover forms a first transition with the web flanks, at least on a first side of the cover facing away from the first end-face side of the stator, and forms a second transition with the inner circumferential surface, wherein at least the first transition or the second transition (preferably both transitions) has/have a radius of at most 0.01 millimeter (mm), in particular at most 0.001 mm.

The green compact thus in particular has a first and/or a second transition with a sharp-edged design, i.e., with a theoretically infinitely small radius. The first side and the web flanks or the first side and the inner circumferential surface, at least in the area of the first or second transition, extend at a right angle (90 degrees) relative to one another, with deviations of at most ±10 degrees in particular likewise being possible.

In particular, the shared contact surfaces extend parallel to the axial direction.

In particular a green compact of a stator-cover unit may thus be provided, which by sintering is suitable for direct use in a camshaft adjuster unit. In particular, no mechanical finishing of the first transition and/or second transition is necessary. In addition, the depressions in the area of the transitions, known from DE 10 2010 008 004 A1, do not have to be provided, so that the leakage between the chambers may be limited or prevented.

According to one advantageous embodiment, the first partial green compact has outwardly pointing external teeth, situated in a radial direction outside the stator wall, as a chain wheel.

The chain wheel is used in a known manner for synchronizing the rotational speeds of the crankshaft and the stator. Thus, the stator and the crankshaft are coupled to one another via the chain wheel, and an adjustment of the camshaft relative to the crankshaft is made possible via the rotor.

In particular, the first partial green compact may also have a two-piece design, in which case a third partial green compact is then provided; the above discussion concerning the connection of the first partial green compact to the second partial green compact applies here. The additional partial green compact, referred to as the third partial green compact, is in particular joined only to the first partial green compact, in particular via a press fit.

According to one advantageous embodiment, on a first side of the cover facing away from the first end-face side of the stator, the cover has at least one depression that is spaced apart from the first transition and the second transition.

The depressions proposed here differ from the depressions known from DE 10 2010 008 004 A1, in that the former are not directly situated at the transitions defined above.

The depressions proposed herein are now used solely for reducing the possible contact surfaces between the blades of a rotor and the first side of the cover when the blades are pivoted between a first web and a second web along the circumferential direction during operation of the camshaft adjuster unit. The shape of the depressions is not specified, provided that leakage between the chambers is not enabled or increased.

In particular, during operation of the camshaft adjuster unit the blades may thus be pivoted across the depressions and up to the web flanks in the circumferential direction, so that the blades and the web flanks (at least almost) contact one another. The blades and the first side of the cover may likewise (at least almost) contact one another, and in this position (i.e., directly adjoining the web flank) may form a sealing surface, since the depressions on the first side of the cover are spaced apart from the first transition.

According to one preferred embodiment, the stator and the cover have different densities. Thus, for example, different properties of the stator and the cover which are adapted to the particular technical requirements may be made possible.

In particular, the first sinter material and the second sinter material are the same or different. This means in particular that the compositions of the alloy components are the same or different. The proportions and the compositions of the additives routinely used for sintering green compacts are likewise preferably the same or different.

In particular, providing the green compact from partial green compacts that are arranged relative to one another with a press fit also allows the same compositions of the alloy components to be used for the first partial green compact and the second partial green compact. The otherwise common use of different alloys, wherein the inner component must have a greater thermal expansion, is not necessary here.

Due to the press fit, the close contact of the shared contact surfaces necessary for sintering the partial green compacts is in particular independent of the alloy composition. Thus, further degrees of freedom are present here for advantageously designing the green compact for the stator-cover unit.

Furthermore, a stator-cover unit is proposed, comprising a sintered green compact described above, wherein the outer circumferential surface of the cover forms a first transition with the web flanks, at least on a first side of the cover facing away from the first end-face side of the stator, and forms a second transition with the inner circumferential surface, wherein at least the first transition or the second transition directly after the sintering has a radius of at most 0.01 millimeter (mm), in particular at most 0.001 mm.

"Directly after the sintering" in this context means that, even after the sintering, no mechanical or other finishing of at least the first transition and/or the second transition is necessary. The dimensional accuracies required for operation in a camshaft adjuster unit are already present directly after the sintering.

In particular, directly after the sintering, on a first side of the cover facing away from the first end-face side of the stator, the cover has at least one depression that is spaced apart from the first transition and the second transition.

As stated above with regard to the green compact, these depressions are used solely for reducing the friction between the blades and the cover during operation of the camshaft adjuster unit.

In particular, a second side of the cover pointing in the other axial direction is situated in flush alignment, or not in exact flush alignment, with the second end-face side of the stator.

In particular, profiles that are preferably similar to the depressions may be provided on the second side, which are used, for example, to reduce the weight of the cover or to mark the stator-cover unit.

The statements concerning the green compact similarly apply for the stator-cover unit, and vice versa.

Furthermore, a camshaft adjuster unit is proposed, comprising at least an above-described stator-cover unit and a rotor having a plurality of blades which, starting from a rotor wall running in the circumferential direction, extend outwardly in the radial direction and are spaced apart from one another in the circumferential direction, wherein a blade is situated in each case between two webs, so that a first chamber is formed between the rotor wall and the stator wall and in each case between a blade and a first web, and a second chamber is formed between the blade and a second web, wherein at least the first transition and the second transition of the stator-cover unit are formed directly by the sintering.

Reference is made to the above discussion concerning the stator-cover unit. The rotor with blades used here corresponds in particular to the embodiments known from the prior art. A special adaptation of the rotor to the stator-cover unit proposed herein is thus in particular not necessary.

According to one preferred embodiment of the camshaft adjuster unit, on a first side of the cover facing away from the first end-face side of the stator, in at least one second area which the at least one blade runs over during operation of the camshaft adjuster unit, the cover has at least one depression that is spaced apart from the first transition and the second transition, wherein the at least one depression is formed directly by the sintering.

As stated above, during operation of the camshaft adjuster unit the blades may thus be pivoted across the depressions and up to the web flanks in the circumferential direction, so that the blades and the web flanks (at least almost) contact one another. In contrast to the cited prior art in DE 10 2010 008 004 A1, in the present case there is no expected leakage via a gap, created by a depression, between the first side of the cover and the blade.

In particular, in the second area which at least one blade runs over during operation of the camshaft adjuster unit and which is situated between the first transition and the at least one depression, or between the second transition and the at least one depression, a first surface of the first side of the cover forms a sliding surface for the at least one blade of the rotor, and is formed directly by the sintering.

This means in particular that this first surface of the first side of the cover directly adjoining the first transition has thus experienced no mechanical or other material-removing machining. By means of the green compact provided here and the subsequent sintering, a camshaft adjuster unit is thus provided in which the stator-cover unit may be inserted for use in the camshaft adjuster unit in particular without finishing, at least in the stated second area.

According to one preferred embodiment, at least all surfaces of the stator-cover unit that enclose the chambers are formed directly by the sintering.

The statements concerning the green compact and the stator-cover unit similarly apply for the camshaft adjuster unit, and vice versa.

Also proposed is a press with a tool for manufacturing an above-described green compact of a stator-cover unit, and with a feeder for a sinterable, powdered (first and/or second) sinter material, wherein the tool has at least the following components:

a first upper punch and a first lower punch that form a first filling chamber for producing the first partial green compact that forms the stator;

a second upper punch and a second lower punch that form a second filling chamber for producing the second partial green compact that forms the cover;

a displacement drive for moving the first partial green compact and the second partial green compact together, with exertion of pressure on the first partial green compact and the second partial green compact to provide a press fit between the partial green compacts;

wherein the press allows production of the first partial green compact, the second partial green compact, and the green compact in a single work operation.

In this regard, reference is made in particular to DE 10 2009 042 598 A1, mentioned at the outset, in which such a press is proposed.

A press, described in DE 10 2009 042 598 A1, for manufacturing the above-described green compact using the partial green compacts defined here is now described, wherein the partial green compacts are produced and then displaced relative to one another in such a way that they may be joined together with a press fit in a single work operation. The production in a single work operation, using a press and a tool, significantly reduces the manufacturing costs for the stator-cover unit described herein. In addition, the special arrangement and configuration of the punches and the travel path of the punches with respect to one another, described in DE 10 2009 042 598 A1, allow the partial green compacts to be produced with a distinct mutual overlap and reproducibly joined to form a green compact.

According to one advantageous embodiment of the press, a third upper punch together with a third lower punch, having a third filling chamber for producing a third partial green compact to be joined to the first partial green compact, is situated in a radial direction outside of and adjoining the first upper punch and the first lower punch, wherein the third partial green compact forms a chain wheel, and the press allows production of the green compact and the third partial green compact in a single work operation.

In particular, the feeder has at least one filling shoe that rotates circularly along a circumferential direction and provides different powdered sinter materials. Reproducible filling, in particular of thin wall areas, may be achieved by this filling shoe which moves along the circumferential direction. In particular, different sinter materials may thus also be reproducibly associated with the first partial green compact, the second partial green compact, and/or a third or further partial green compact. Such a filling shoe is known from DE 10 2014 006 371 A1 and DE 10 2014 006 374 A1, for example.

The statements concerning the green compact, the stator-cover unit, and the camshaft adjuster unit similarly apply for the press, and vice versa.

Furthermore, a method for manufacturing an (above-described) green compact of a stator-cover unit using a press proposed herein is disclosed, comprising at least the following steps:

producing the first partial green compact in a first work chamber of the pressing tool by pressing a first sinter material;

producing the second partial green compact in a second work chamber of the pressing tool by pressing a second sinter material;

moving the first partial green compact relative to the second partial green compact and joining the partial green compacts with provision of a press fit;

sintering the one-piece green compact to form a one-piece stator-cover unit, so that sintering takes place, at least partially, at adjoining shared contact surfaces of the partial green compacts.

In this regard, reference is also made in particular to above-mentioned DE 10 2009 042 598 A1, in which such a method is proposed.

At this point, the method described in DE 10 2009 042 598 A1 for manufacturing the above-described green compact, using the partial green compacts defined herein, is described, wherein the partial green compacts are produced and then moved relative to one another in such a way that they may be joined together with a press fit in a single work operation.

In particular, steps a), b), and c) may also be carried out in some other sequence or at times in parallel to one another. In particular, it is possible to first produce one of the partial green compacts, and to produce the other partial green compact only after or during displacement of the partial green compacts relative to one another.

In particular, after step c) the green compact is removed from the press and sintered in a sintering furnace to form the one-piece stator-cover unit (the first partial green compact and the second partial green compact are then integrally joined together).

Integrally joined connections refer to any connection in which the connection partners (first partial green compact and second partial green compact after the sintering) are held together by atomic or molecular forces. At the same time, they are nondetachable connections that may be separated only by destroying the connections (connecting means).

In particular it is proposed that steps a) through c) are carried out in coordination with one another in a single pressing tool and in a single work operation. The work chamber for the particular partial green compact is formed in particular by the respective filling chamber described in conjunction with the press, wherein the work chamber describes the filling chamber which is closed off on the outside (i.e., with respect to the feeder of the powdered sinter material).

The statements concerning the green compact, the stator-cover unit, the camshaft adjuster unit, and the press similarly apply for the method, and vice versa.

Figure 2:
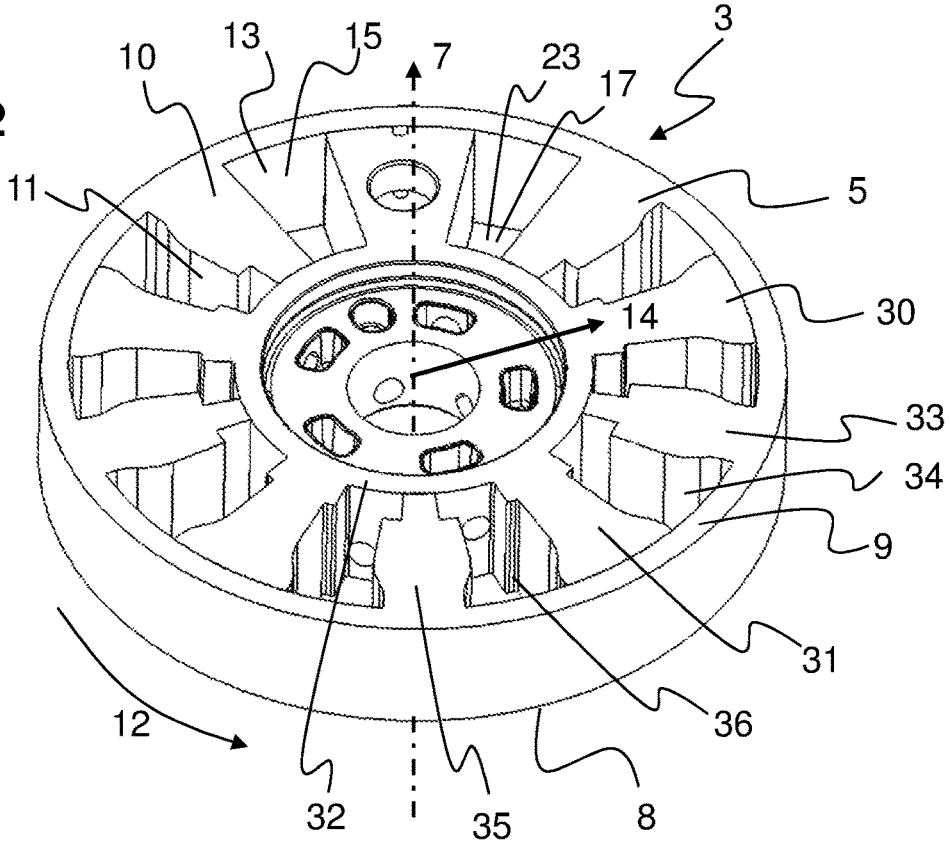

As a precaution, it is noted that the ordinal numbers used herein ("first," "second," "third," . . . ) are used primarily (only) to distinguish between multiple, possibly similar, objects, variables, or processes; i.e., in particular no dependency and/or sequence of these objects, variables, or processes relative to one another are/is necessarily specified. If a dependency and/or sequence is necessary, this is explicitly indicated herein, or is readily apparent to those skilled in the study of the embodiment specifically described The invention and the technical context are explained in greater detail below with reference to the figures. It is pointed out that the invention is not to be construed as being limited by the illustrated exemplary embodiments. In particular, unless explicitly stated otherwise, it is also possible to extract partial aspects of the information shown in the figures and combine them with other components and findings from the present description and/or figures. Identical objects are denoted by the same reference numerals, so that explanations concerning other figures may possibly be supplementally used. The figures schematically show the following:

FIG. 1: shows the method and the press for manufacturing the green compact;

FIG. 2: shows a camshaft adjuster unit in a perspective view;

FIG. 3: shows the camshaft adjuster unit in a top view in at least a partial cross section;

FIG. 4: shows a first embodiment variant of a green compact for a stator-cover unit in a perspective view;

FIG. 5: shows a second embodiment variant of a green compact for a stator-cover unit with a chain wheel, in a perspective view;

FIG. 6: shows the green compact according to FIG. 4 in a top view;

FIG. 7: shows the green compact according to FIG. 6 in a side sectional view;

FIG. 8: shows a detail from FIG. 7;

FIG. 9: shows the green compact according to FIG. 5 in a top view;

FIG. 10: shows the green compact according to FIG. 9 in a sectional side view;

FIG. 11: shows a detail from FIG. 10; and

FIG. 12: shows a third embodiment variant of a green compact for a stator-cover unit with a chain wheel, in a perspective view.

FIG. 1 shows the method and the press 41 for manufacturing the green compact 1. The individual method steps are illustrated in succession in diagrams A through E. Diagram A shows the filling of the filling chambers 45, 48. Diagram B shows the formation of the work chambers 53, 54. Diagram C shows method steps a) and b), i.e., the production of the partial green compacts 4, 16. Diagram D shows method step c), i.e., the displacement of the partial green compacts 4, 16 to become joined with provision of a press fit 22. Diagram E shows the ejection of the green compact 1.

The press 41 includes a tool 42 for manufacturing a green compact 1 of a stator-cover unit 2, and a feeder 50 for sinterable, powdered (first and second) sinter material 6, 18. The tool 42 has a first upper punch 43 and a first lower punch 44, which form a first filling chamber 45 for producing the first partial green compact 4 that forms the stator 5. The tool also includes a second upper punch 46 and a second lower punch 47, which form a second filling chamber 48 for producing the second partial green compact 16 that forms the cover 17. Also illustrated here is a displacement drive 49 that is provided for moving the first partial green compact 4 and the second partial green compact 16 together, with exertion of pressure on the first partial green compact 4 and the second partial green compact 16, to provide a press fit 22 between the partial green compacts 4, 16. The press 41 allows production of the first partial green compact 4, the second partial green compact 16, and the green compact 1 in a single work operation.

In this regard, reference is made in particular to abovementioned DE 10 2009 042 598 A1, in which such a press 41 is proposed and described.

After step c) (diagram D), the green compact 1 is removed from the press (diagram E) and sintered in a sintering furnace to form a one-piece stator-cover unit 2 (the first partial green compact 4 and the second partial green compact 16 are integrally joined together after the sintering).

FIG. 2 shows a camshaft adjuster unit 3 in a perspective view. The camshaft adjuster unit 3 includes a stator-cover unit 2 and a rotor 30 having a plurality of blades 31 which, starting from a rotor wall 32 running in the circumferential direction 12, extend outwardly in the radial direction 14 and are spaced apart from one another in the circumferential direction 12, wherein a blade 31 is situated in each case between two webs 10 of the stator 5, so that a first chamber 34 is formed between the rotor wall 32 and the stator wall 13 and in each case between a blade 31 and a first web 33, and a second chamber 36 is formed between the blade 31 and a second web 35.

The stator-cover unit 2 has a stator 5 in each case with a first end-face side 8 and a second end-face side 9 pointing in an axial direction 7, and in between a plurality of webs 10 having lateral web flanks 11, wherein the webs 10, starting from an outer stator wall 13 running in a circumferential direction 12, extend inwardly in a radial direction 14 and are spaced apart from one another in the circumferential direction 12, so that the stator wall 13 in each case forms an inner circumferential surface 15 between the webs 10. The stator-cover unit 2 also includes a cover 17 having an outer circumferential surface 19 (see FIG. 7) running in the circumferential direction 12 and situated on the first end-face side 8 of the stator 5 and at least partially covering a first area 20 (see FIG. 7) extending between the webs 10 and within the stator wall 13.

FIG. 3 shows the camshaft adjuster unit 1 in a top view in at least a partial cross section. Reference is made to the discussion for FIG. 2. The first chambers 34 are denoted here by reference character "L," and the second chambers 36 are denoted by reference character "R."

FIG. 4 shows a first embodiment variant of a green compact 1 for a stator-cover unit 2 in a perspective view. The green compact 1 has a first partial green compact 4 as the stator 5, made of a first sinter material 6, in each case with a first end-face side 8 and a second end-face side 9 pointing in an axial direction 7, and in between a plurality of webs 10 having lateral web flanks 11. The webs 10, starting from an outer stator wall 13 running in a circumferential direction 12, extend inwardly in a radial direction 14 and are spaced apart from one another in the circumferential direction 12, so that the stator wall 13 in each case forms an inner circumferential surface 15 between the webs 10. The green compact 1 also includes a second partial green compact 16 as the cover 17, made of a second sinter material 18, having an outer circumferential surface 19 (see FIG. 7) running in the circumferential direction 12 and situated on the first end-face side 8 of the stator 5. The cover 17 completely covers a first area 20 that extends between the webs 10 and within the stator wall 13. The outer circumferential surface 19 of the cover 17 adjoins the inner circumferential surface 15 and the web flanks 11 of the stator 5 and forms shared contact surfaces 21, and the cover 17 and the stator 5 are joined together via these contact surfaces 21 by means of a press fit 22 (see FIG. 7).

On a first side 23 of the cover 17 facing away from the first end-face side 8 of the stator 5, the outer circumferential surface 19 of the cover 17 has a first transition 24 with the web flanks 11, and has a second transition 25 with the inner circumferential surface 15. The green compact 1 has transitions 24, 25 with a sharp-edged design i.e., with a theoretically infinitely small radius 26 (see FIG. 8). The first side 23 and the web flanks 11 or the first side 23 and the inner circumferential surface 15, at least in the area of the first and second transitions 24, 25, extend at a right angle (90 degrees) relative to one another. The shared contact surfaces 21 extend parallel to the axial direction 7.

FIG. 5 shows a second embodiment variant of a green compact 1 for a stator-cover unit 2 with a chain wheel 28, in a perspective view. The first partial green compact 4 (the stator 5) has outwardly pointing external teeth 27, situated in a radial direction 14 outside the stator wall 13, as a chain wheel 28.

The first partial green compact 4 may also have a two-piece design, in which case a third partial green compact 51, joined only to the first partial green compact 4 via a press fit 22, is provided.

FIG. 6 shows the green compact 1 according to FIG. 4 in a top view. Reference is made to the discussion for FIG. 4. FIG. 6 also shows the section line in the illustration according to FIG. 7.

FIG. 7 shows the green compact 1 according to FIG. 6 in a side sectional view. Reference is made to the discussion for FIGS. 4 and 6. The green compact 1 includes, in addition to the first partial green compact 4 (stator 5), a second partial green compact 16 as the cover 17, made of a second sinter material 18, having an outer circumferential surface 19 running in the circumferential direction 12 and situated on the first end-face side 8 of the stator 5. The first end-face side 8 of the stator is in flush alignment with the cover 17. The cover 17 completely covers a first area 20 that extends between the webs 10 and within the stator wall 13. The outer circumferential surface 19 of the cover 17 adjoins the inner circumferential surface 15 and the web flanks 11 of the stator 5 and forms shared contact surfaces 21, and the cover 17 and the stator 5 are joined together via these contact surfaces 21 by means of a press fit 22.

On a first side 23 of the cover 17 facing away from the first end-face side 8 of the stator 5, the outer circumferential surface 19 of the cover 17 has a first transition 24 with the web flanks 11, and has a second transition 25 with the inner circumferential surface 15. The green compact 1 has transitions 24, 25 with a sharp-edged design i.e., with a theoretically infinitely small radius 26 (see FIG. 8). The first side 23 and the web flanks 11 or the first side 23 and the inner circumferential surface 15, at least in the area of the first and second transitions 24, 25, extend at a right angle (90 degrees) relative to one another. The shared contact surfaces 21 extend parallel to the axial direction 7.

FIG. 8 shows a detail from FIG. 7. On a first side 23 of the cover 17 facing away from the first end-face side 8 of the stator 5, the outer circumferential surface 19 of the cover 17 has a second transition 25 with a sharp-edged design, i.e., with a theoretically infinitely small radius 26. The first side 23 and the inner circumferential surface 15, at least in the area of the second transition 25, extend at a right angle (90 degrees) relative to one another. The shared contact surfaces 21 extend parallel to the axial direction 7.

FIG. 9 shows the green compact 1 according to FIG. 5 in a top view. Reference is made to the discussion for FIG. 5. FIG. 9 also shows the section line in the illustration according to FIG. 10.

FIG. 10 shows the green compact 1 according to FIG. 9 in a sectional side view. Reference is made to the discussion for FIGS. 5 and 8. In contrast to FIG. 8, the first partial green compact 4 (the stator 5) here has outwardly pointing external teeth 27, situated in a radial direction 14 outside the stator wall 13, as a chain wheel 28.

FIG. 11 shows a detail from FIG. 10. In this regard, reference is made to the discussion for FIG. 8 and the second transition 25.

FIG. 12 shows a third embodiment variant of a green compact 1 for a stator-cover unit 2 with a chain wheel 28, in a perspective view. Reference is made to the discussion for FIG. 4. On a first side 23 of the cover 17 facing away from the first end-face side 8 of the stator 5, in at least one second area 37 which the at least one blade 31 runs over during operation of the camshaft adjuster unit 3, the cover 17 of the green compact 1 has a plurality of depressions 29 that are spaced apart from the first transition 24 and the second transition 25. During operation of the camshaft adjuster unit 3, the blades 31 may be pivoted across the depressions 29 and up to the web flanks 11 in the circumferential direction 12, so that the blades 31 and the web flanks 11 (at least almost) contact one another.

In the second area 37 which a blade 31 runs over during operation of the camshaft adjuster unit 3, and which is situated between the first transition 24 and a (next) depression 29 or between the second transition 25 and the (next) depression 29, a first surface 38 of the first side 23 of the cover 17 forms a sliding surface 39 for the blade 31 of the rotor 30.

The depressions 29 shown here are used solely to reduce the possible contact surfaces between the blades 31 of a rotor 30 and the first side 23 of the cover 17 when the blades 31 are pivoted between a first web 33 and a second web 35 along the circumferential direction 12 during operation of the camshaft adjuster unit 3.

LIST OF REFERENCE NUMERALS

1 green compact
2 stator-cover unit
3 camshaft adjuster unit
4 first partial green compact
5 stator
6 first sinter material
7 axial direction
8 first end-face side
9 second end-face side
10 web
11 web flank
12 circumferential direction
13 stator wall
14 radial direction
15 inner circumferential surface
16 second partial green compact
17 cover
18 second sinter material
19 outer circumferential surface
20 first area
21 contact surface
22 press fit
23 first side
24 first transition
25 second transition
26 radius
27 external teeth
28 chain wheel
29 depression
30 rotor
31 blade
32 rotor wall
33 first web
34 first chamber
35 second web
36 second chamber
37 second area
38 first surface
39 sliding surface
40 surface
41 press
42 tool
43 first upper punch
44 first lower punch
45 first filling chamber
46 second upper punch
47 second lower punch
48 second filling chamber
49 displacement drive
50 feeder
51 third partial green compact
52 filling shoe
53 first work chamber
54 second work chamber

The invention claimed is:

1. A green compact of a stator-cover unit for a camshaft adjuster unit, at least comprising a first partial green compact, as a stator, made of a first sinter material, in each case with a first end-face side and a second end-face side pointing in an axial direction, and in between a plurality of webs having lateral web flanks, wherein the webs, starting from an outer stator wall running in a circumferential direction, extend inwardly in a radial direction and are spaced apart from one another in the circumferential direction, so that the stator wall in each case forms an inner circumferential surface between the webs, and a second partial green compact, as a cover, made of a second sinter material, having an outer circumferential surface running in the circumferential direction and situated on the first end-face side of the stator and at least partially covering a first area extending between the webs and within the stator wall;

wherein the outer circumferential surface of the cover adjoins the inner circumferential surface and the web flanks of the stator and forms shared contact surfaces, and the cover and the stator are joined together via these contact surfaces by a press fit and wherein the first partial green compact, the second partial green compact, and the green compact formed by the press fit between the first partial green compact and the second partial green compact are produced in a single work operation of a press.

2. The green compact according to claim 1, wherein the outer circumferential surface of the cover forms a first transition with the web flanks, at least on a first side of the cover facing away from the first end-face side of the stator, and forms a second transition with the inner circumferential surface, wherein at least the first transition or the second transition has a radius of at most 0.01 millimeter (mm).

3. The green compact according to claim 2, wherein at least on a first side of the cover facing away from the first end-face side of the stator, the cover has at least one depression that is spaced apart from the first transition and the second transition.

4. The green compact according to claim 1, wherein the shared contact surfaces extend parallel to the axial direction.

5. The green compact according to claim 1, wherein the first partial green compact has outwardly pointing external teeth, situated in a radial direction outside the stator wall, as a chain wheel.

6. The green compact according to claim 1, wherein the stator and the cover have different densities.

7. The green compact according to claim 1, wherein the first sinter material and the second sinter material are identical to one another.

8. A stator-cover unit comprising a sintered green compact according to claim 1, wherein the outer circumferential surface of the cover forms a first transition with the web flanks, at least on a first side of the cover facing away from the first end-face side of the stator, and forms a second transition with the inner circumferential surface, wherein at least the first transition or the second transition directly after the sintering has a radius of at most 0.01 millimeter (mm).

9. The stator-cover unit according to claim 8, wherein directly after the sintering, at least on a first side of the cover facing away from the first end-face side of the stator, the cover has at least one depression that is spaced apart from the first transition and the second transition.

10. The camshaft adjuster unit according to claim 9, wherein at least all surfaces of the stator-cover unit that delimit the chambers are formed directly by the sintering.

11. A camshaft adjuster unit, at least comprising a stator-cover unit according to claim 8, and a rotor having a plurality of blades which, starting from a rotor wall running in the circumferential direction, extend outwardly in the radial direction and are spaced apart from one another in the circumferential direction, wherein a blade is situated in each case between two webs, so that a first chamber is formed between the rotor wall and the stator wall and in each case between a blade and a first web, and a second chamber is formed between the blade and a second web, wherein at least the first transition and the second transition of the stator-cover unit are formed directly by the sintering.

12. The camshaft adjuster unit according to claim 11, wherein on a first side of the cover facing away from the first end-face side of the stator, in at least one second area which the at least one blade runs over during operation of the camshaft adjuster unit, the cover has at least one depression that is spaced apart from the first transition and the second transition, wherein the at least one depression is formed directly by the sintering.

13. The camshaft adjuster unit according to claim 12, wherein in the second area which at least one blade runs over during operation of the camshaft adjuster unit and which is situated between the first transition and the at least one depression, or between the second transition and the at least one depression, a first surface of the first side of the cover forms a sliding surface for the at least one blade of the rotor, and is formed directly by the sintering.

14. The green compact according to claim 1, wherein the first partial green compact and the second partial green compact are arranged relative to one another creating right-angled edges at respective transitions from the web flanks and the inner circumferential surface of the first partial green compact as the stator to a first side of the second partial green compact as the cover in which the first side faces away from the first end-face side of the stator.

15. A press with a tool for manufacturing a green compact of a stator-cover unit including a first partial green compact, as a stator, made of a first sinter material, in each case with a first end-face side and a second end-face side pointing in an axial direction, and in between a plurality of webs having lateral web flanks, wherein the webs, starting from an outer stator wall running in a circumferential direction, extend inwardly in a radial direction and are spaced apart from one another in the circumferential direction, so that the stator wall in each case forms an inner circumferential surface between the webs, and further including a second partial green compact, as a cover, made of a second sinter material, having an outer circumferential surface running in the circumferential direction and situated on the first end-face side of the stator and at least partially covering a first area extending between the webs and within the stator wall, wherein the outer circumferential surface of the cover adjoins the inner circumferential surface and the web flanks of the stator and forms shared contact surfaces, in which the cover and the stator are joined together via these contact surfaces by a press fit, and the press further with a feeder for a sinterable, powdered sinter material, wherein the tool has at least the following components:

- a first upper punch and a first lower punch that form a first filling chamber for producing the first partial green compact that forms the stator;
- a second upper punch and a second lower punch that form a second filling chamber for producing the second partial green compact that forms the cover;
- a displacement drive for moving the first partial green compact and the second partial green compact together, with exertion of pressure on the first partial green compact and the second partial green compact to provide a press fit between the partial green compacts;

wherein the press allows production of the first partial green compact, the second partial green compact, and the green compact in a single work operation.

16. The press according to claim 15, wherein the feeder has at least one filling shoe that rotates circularly along a circumferential direction and provides different powdered sinter materials.

17. The press according to claim 15, wherein the first partial green compact and the second partial green compact are arranged relative to one another creating right-angled edges at respective transitions from the web flanks and the inner circumferential surface of the first partial green compact as the stator to a first side of the second partial green compact as the cover in which the first side faces away from the first end- face side of the stator.

18. A method for manufacturing a green compact of a stator-cover unit using a press, the green compact including a first partial green compact, as a stator, made of a first sinter material, in each case with a first end-face side and a second end-face side pointing in an axial direction, and in between a plurality of webs having lateral web flanks, wherein the webs, starting from an outer stator wall running in a circumferential direction, extend inwardly in a radial direction and are spaced apart from one another in the circumferential direction, so that the stator wall in each case forms an inner circumferential surface between the webs, and further including a second partial green compact, as a cover, made of a second sinter material, having an outer circumferential surface running in the circumferential direction and situated on the first end-face side of the stator and at least partially covering a first area extending between the webs and within the stator wall, wherein the outer circumferential surface of the cover adjoins the inner circumferential surface and the web flanks of the stator and forms shared contact surfaces, in which the cover and the stator are joined together via these contact surfaces by a press fit, and the press with a tool for manufacturing a green compact of a stator-cover unit and with a feeder for a sinterable, powdered sinter material, wherein the tool has a first upper punch and a first lower punch that form a first filling chamber for producing the first partial green compact that forms the stator, a second upper punch and a second lower punch that form a second filling chamber for producing the second partial green compact that forms the cover, and a displacement drive for moving the first partial green compact and the second partial green compact together, with exertion of pressure on the first partial green compact and the second partial green compact to provide a press fit between the partial green compacts wherein the press allows production of the first partial green compact, the second partial green compact, and the green compact in a single work operation, the method comprising at least the following steps:

a) producing the first partial green compact in a first work chamber of the tool by pressing a first sinter material;

b) producing the second partial green compact in a second work chamber of the tool by pressing a second sinter material;

c) moving the first partial green compact relative to the second partial green compact and joining the partial green compacts with provision of a press fit;

d) sintering the one-piece green compact to form a one-piece stator-cover unit, so that sintering takes place, at least partially, at adjoining shared contact surfaces of the partial green compacts.

19. The method according to claim 18, wherein steps a) through c) are carried out in coordination with one another in a single tool and in a single work operation.

20. The press according to claim 18, wherein the first partial green compact and the second partial green compact are arranged relative to one another creating right-angled edges at respective transitions from the web flanks and the inner circumferential surface of the first partial green compact as a stator to a first side of the second partial green compact as the cover in which the first side faces away from the first end-face side of the stator.

* * * * *